United States Patent [19]

Smith

[11] 4,183,348

[45] Jan. 15, 1980

[54] FIREPLACE FRONT

[76] Inventor: Joseph O. Smith, 4419 W. Kings Corner, Glennie, Mich. 48737

[21] Appl. No.: 837,695

[22] Filed: Sep. 29, 1977

[51] Int. Cl.[2] ..... F24C 15/10

[52] U.S. Cl. ..... 126/140; 126/202; 160/DIG. 9

[58] Field of Search ..... 126/140, 202; 160/33, 160/DIG. 9

[56] References Cited

U.S. PATENT DOCUMENTS

| | | | |
|---|---|---|---|
| 7,608 | 8/1850 | Stuart | 126/202 |
| 253,127 | 1/1882 | Suggs | 126/202 |
| 453,765 | 6/1891 | Vance | 126/202 |
| 579,987 | 4/1897 | Jordan | 126/202 |
| 652,509 | 6/1900 | Cox | 126/140 |
| 1,726,854 | 9/1929 | Mumford | 126/140 |
| 2,294,046 | 8/1942 | Cser | 126/202 |
| 2,355,803 | 8/1944 | Hopewell | 160/33 |
| 2,501,278 | 3/1950 | Hughes | 126/202 |
| 2,776,707 | 1/1957 | Helwig | 126/140 |
| 2,939,450 | 6/1960 | Rubens | 126/140 |
| 3,440,766 | 4/1969 | Heppenstall | 126/140 |
| 4,059,091 | 11/1977 | Cobb | 126/140 |

FOREIGN PATENT DOCUMENTS

| | | | |
|---|---|---|---|
| 667570 | 3/1952 | United Kingdom | 126/202 |
| 771207 | 3/1957 | United Kingdom | 126/140 |

*Primary Examiner*—Ronald C. Capossela

[57] ABSTRACT

A fireplace front and method of making a fireplace front for closing a forward opening in a fire chamber, including: upper and lower sets of front and rear tracks, a pair of transparent, imperforate doors and a pair of perforate screen doors mounted on the front and rear tracks, respectively, for individual sliding movement between closed positions, in which they cover the opening and retracted positions. Enclosed pockets or wells are fixed to the tracks at opposite sides of the opening for receiving the doors when they are in the retracted positions.

18 Claims, 15 Drawing Figures

X
Y
98
99
100
101
102
102'
103
103'
104
104'
105
105'
106
106'
107
108
109
109'
110
112
114
92
93
95
96

FIREPLACE FRONT

BACKGROUND OF THE INVENTION

This invention relates to a fireplace front and method of making same, and more particularly to a fireplace front including a pair of screen doors and a pair of transparent, imperforate doors which can be selectively moved to positions covering a front opening in a fireplace and retracted, concealed positions.

The openings in many fireplaces are sometimes covered by decorative screens which inhibit the passage of airborne sparks onto the floor immediately adjacent the fireplace opening but permits the free flow of room air to the fire chamber to enhance burning during fire start-up. The screens can generally be parted to provide access to the fireplace for cleaning and insertion of wood.

Once a fire is well established, the heated air rising in the fireplace and passing outwardly through the chimney, tends to create a vacuum which draws room air through the screen into the fireplace. This creates a draft which cools the house. When burning softwood, the draft sometimes so accelerates the burning that the softwood will literally explode with sufficient force to pass through the screen into the room creating a fire hazard. Accordingly, imperforate doors or panels of heat-resistant material, such as glass, are sometimes employed to cover the fireplace opening and control the draft, and yet permit the fire to be viewed. Such panels or doors are generally removed or folded open during fire start-up because in the closed positions they block the free flow of air and burning is inhibited. When the imperforate doors are opened during fire start-up, it is generally desirable to temporarily cover the fireplace opening with a screen to inhibit the passage of sparks which might otherwise fly onto the floor in front of the fireplace. The storage of the unused set of the glass doors and screen doors presents a problem to the homeowner.

It is an object of the present invention therefore to provide a compact fireplace front embodying slidable screen doors and imperforate doors which can be selectively moved between positions covering the fireplace opening and spread positions out of view.

It is another object of the present invention to provide an improved fireplace front of the type described which will more effectively control the draft to the fire chamber.

Still another object of the present invention is to provide a fireplace front of the type described including a double track frame which slidably mounts imperforate doors and has enclosed door wells mounted on opposite sides of a central fireplace opening for receiving the doors and mechanism for inhibiting the flow of air between the doors and the front portion of the door wells.

Yet another object of the present invention is to provide a fireplace front of the type described including door receiving pockets, at opposite sides of a central opening, having rearwardly extending vertical flanges adapted to engage a fireplace chamber to inhibit the flow of air between the chamber and the pockets.

A further object of the present invention is to provide a fireplace front of the type described including front and rear sets of lower and upper tracks including a pair of forwardly extending, vertical, expansion flanges on the front set of tracks at laterally opposite sides of a central opening and a pair of rearwardly extending, vertical locating flanges on the rear set of tracks at laterally opposite sides of the central opening.

It is another object of the present invention to provide a plural door fireplace closure unit for closing the front opening of a fireplace of the type described wherein expansion pockets are provided to prevent interference of the doors and the door receiving enclosures.

It is another object of the present invention to provide a fireplace closure unit of the type described having integral mechanism which is sandwiched in an overlying brick wall for securely coupling the unit to the brick wall.

Some pre-fabricated fireplaces are now being constructed with firepits having a shallow depth. If the imperforate glass doors are hung in the usual fashion, they may overheat. It is another object of the present invention to provide apparatus of the type described having spacer members which automatically space the doors from the backwall of a short depth firepit a distance equal to the spacing of the doors from the backwall of a normal size firepit.

It is another object of the present invention to provide a new and novel method of making a fireplace door.

It is another object of the present invention to provide a fireplace front having a new and novel hangar bracket which will minimize drafts past the fireplace doors when the doors are closed.

It is another object of the present invention to provide a new and novel fireplace front of the type described having new and novel hangar brackets on which the fireplace doors are vertically adjustable for quick removal.

Other objects and advantages of the present invention will become apparent to those of ordinary skill in the art as the description thereof proceeds.

SUMMARY OF THE INVENTION

A fireplace front including upper and lower sets of tracks mounting pairs of screen doors and pairs of imperforate, heat-resistant doors on the front of a fire chamber for individual sliding movement between closed positions covering a front opening in the fire chamber and spread positions. Door wells are provided at opposite sides of the opening for receiving the doors in the spread positions. Closure members, provided on the heat-resistant doors and the door wells, cooperate to inhibit the passage of air therebetween when the heat-resistant doors are in the closed positions to control the burning at an acceptable level.

The present invention may more readily be understood by reference to the accompanying drawings in which.

DESCRIPTION OF THE PREFERRED EMBODIMENT

Figure 1:
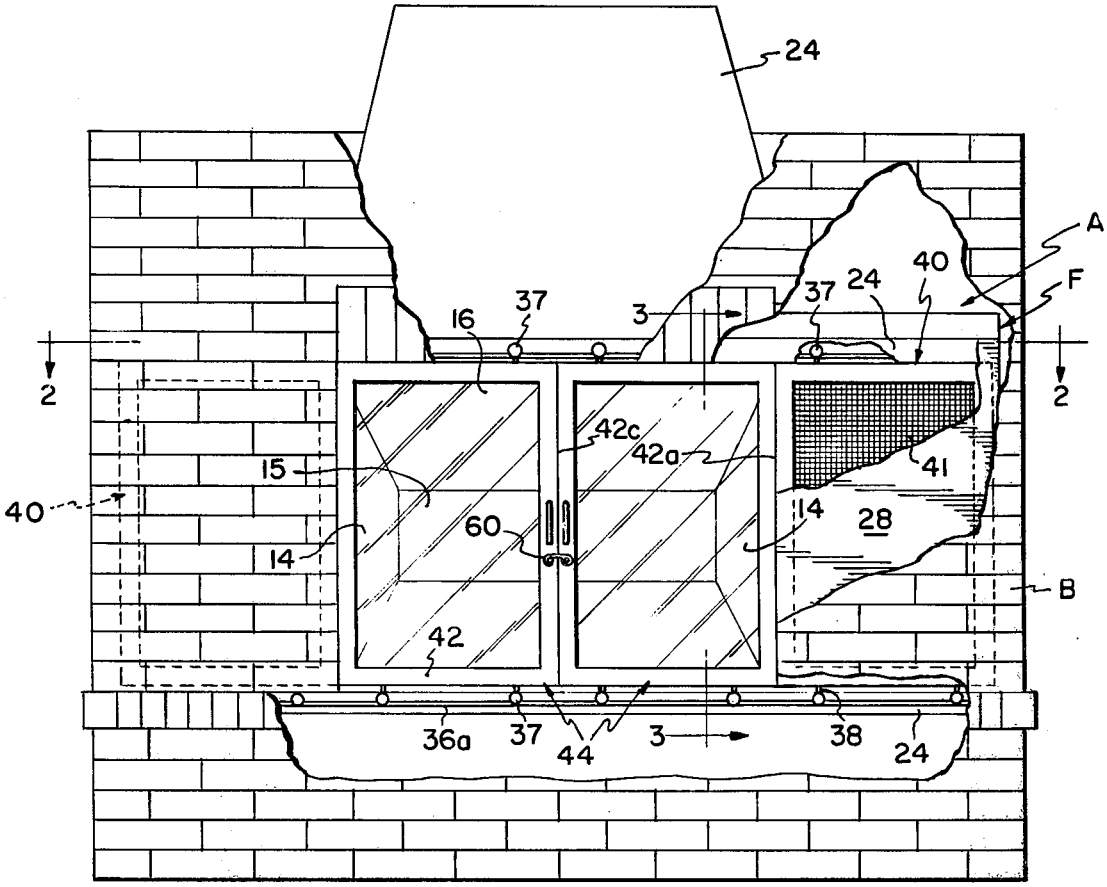
FIG. 1 is a front elevational view of a fireplace mounting a fireplace front constructed according to the present invention, parts being broken away to more clearly illustrate underlying portions thereof.
Figure 2:
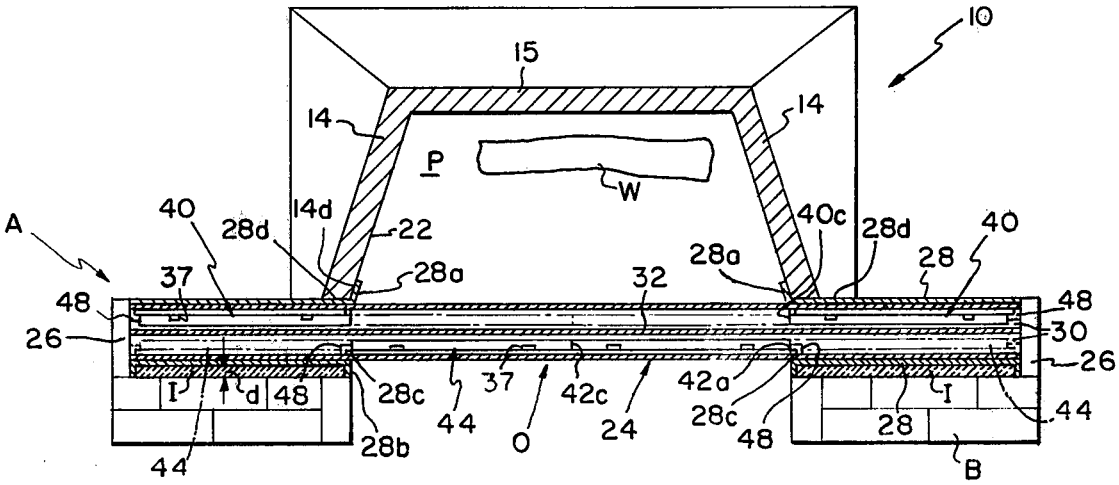
FIG. 2 is a sectional plan view, taken along the line 2—2 of FIG. 1.
Figure 3:
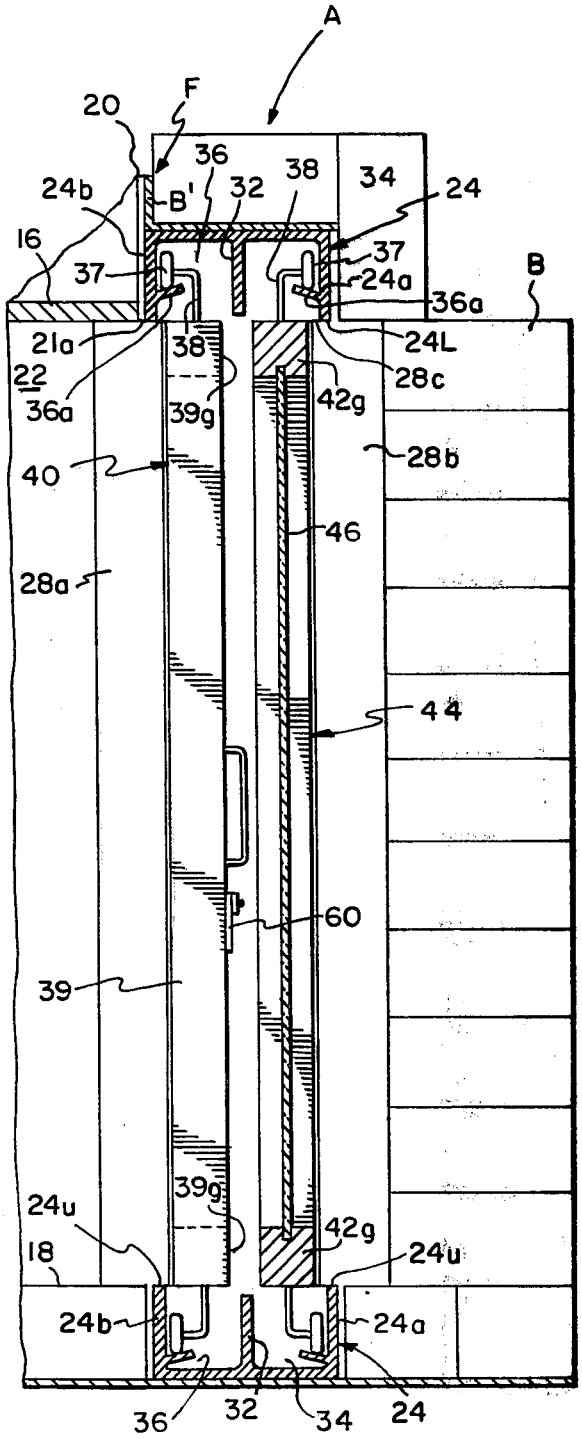
FIG. 3 is an enlarged, sectional end view, taken along the line 3—3 of FIG. 1.

A fireplace front constructed according to the present invention is generally designated A and is particularly adapted for use with a conventional, metal, firepot or heat chamber, generally designated 10 (FIG. 2), having a firepit P defined by rearwardly converging side walls 14, spanned by a back wall 15 and a top wall 16 (FIGS. 1 and 3). The top wall 16 rearwardly converges downwardly toward a generally horizontal brick or masonry hearth 18 on which the firepot 10 rests. A chimney 24 communicates with an opening in the top wall 16 for carrying off the smoke, as usual. The fire chamber 10 includes a vertical, front wall 20 having a fireplace opening 22 through which wood, schematically illustrated at W, is inserted in the firepit P, where burning takes place on the hearth 18, as usual.

The fireplace front A comprises a rectangular frame, generally designated F, including upper and lower sets of door mounting, metal tracks 24, spanned by channel-shaped vertical end members 26. A longitudinally extending, angle bracket B' is riveted to the upper track 24 for mounting the frame F on the front wall 20. A pair of substantially airtight, door-receiving wells or pockets 30 are provided at opposite sides of a central frame opening O which is aligned with the fire chamber opening 22. The door receiving wells or pockets 30 are defined by front and rear pairs of metal panels or sheathing 28 welded to the front and rear vertical side wall portions **24*a* and 24*b* of the upper and lower tracks 24 and the channel-shaped end members 26. The air-tight pockets 30 aid in controlling the draft to the firepit P as will become apparent. The upper and lower door mounting tracks 24 are divided by vertical partitions 32 to provide a front set of upper and lower, door-receiving track runways 34 and a rear set of upper and lower, door-receiving track runways 36**.

The longitudinally innermost, vertical edge portions **28*a* of the rear pocket defining panels 28 are bent inwardly to provide a pair of rearwardly converging, generally vertical, integral flange members which are generally parallel to and abut the fire chamber side walls 14 so as to inhibit the passage of air between the abutting surfaces 14*d* and 28*d* (FIG. 2) of the fireplace chamber side walls 14 and the rear pocket defining panels 28, respectively. The rearwardly extending flanges 28*a* serve as a height guage and the upper ends thereof bear against the underside 21*a* of the fire chamber front wall 20 for quickly and properly vertically locating the fireplace front. The relative dimensions of the parts are such that the fireplace front will be accurately vertically positioned when the upper ends of the flanges 28*a* bear against the underside 21*a* of the front wall 20**. An unskilled installer can thus accurately and quickly install the fireplace front A without making time-consuming measurements.

The tracks 24 and the panels 28 generally comprise metal, such as aluminum or steel, which expand when heated. To allow for such expansion, the longitudinally inner, vertical edge portions **28*b* of the front pocket defining walls or panels 28 are bent outwardly to provide a pair of integral, generally parallel, expansion flanges 28*b* which also serve to stiffen the plates 28. Fireplace brick, generally designated B, are layed in rows across the front of the front pocket defining panels 28. The inner end bricks B abut the expansion flanges 28*b* and extend generally parallel to the pocket defining plates 28 to provide a decorative covering for the panels 28. A gap d is provided between the bricks B and the front pocket defining panels 28 and is filled with compressible insulation I (FIG. 2). The gap d permits the metal, pocket defining panels 28 to outwardly expand when heated without deforming the masonry of fire bricks B. The forwardly extending, expansion flanges 28*b* also serve as a guide to a mason. In order to lay the brick B so that the fireplace opening 22 is completely exposed, a mason need only lay the longitudinally innermost brick B flush with the longitudinally inner surfaces of the expansion flanges 28*b* and the bricks B immediately overlying the opening 22 flush with the lowermost edge 24L (FIG. 3) of the upper track front wall 24*a***.

Fixed to the inside or rear of the front pocket defining walls or panels 28 are generally vertical, rearwardly extending flanges **28*c* providing stops on opposite sides of the opening 22, extending between the upper and lower sets of tracks 24 for a purpose to become immediately apparent. It is important to note that the rearwardly extending pocket flanges 28*c* extend from a position flush with the lower ends 24L of the track side walls 24*a*, 24*b* of the upper track 24 to a position flush with the upper ends 24*u* of the track sidewalls 24*a* and 24*b* of the lower track 24. The lower track 24 is recessed in the hearth 18 so that the upper ends 24*u* are flush with the top of the hearth 18**.

Internally mounted on the inner and outer track side walls **24*a*, 24*b* of the upper and lower sets of tracks 24 are slightly vertically inclined, roller-receiving rails 36*a*. Slidably received in the rear runways 36 is a pair of screen doors, generally designated 40, movable between the retracted positions, illustrated in solid lines in FIG. 2, and the abutting positions, illustrated in chain lines in FIG. 2, in which they cover the fireplace opening 22. The screen doors 40 include generally rectangular frames 39 mounting fireplace screens 41 and are supported on the rails 36*a* via door hangers 38 and rollers 37**.

Figure 4:
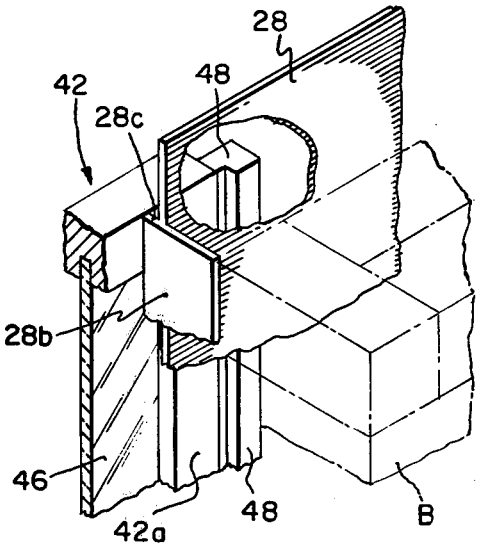
FIG. 4 is an enlarged perspective view illustrating the mechanism for inhibiting the flow of air between one of the door wells and one of the imperforate doors.

Slidably movable in the front set of runways 34, between the closed, abutting positions illustrated in solid lines in FIG. 3 and the spread, open positions, illustrated in chain lines in FIG. 2, on opposite sides of the door opening 22, is a set of imperforate doors 44 including generally rectangular door frames 42 mounting panels 46 of heat-resistant material, such as "Pyrex" glass. The door frames 42 are supported on the external track rails **36*a* via hangers 38 and rollers 37. The longitudinally outer, vertical side frame portions 42*a* (FIGS. 2 and 4) of the door frames 42 mount generally vertical flange members 48 which extend the full length of the doors 44** and are engageable with the stops 28c to inhibit the passage of air between the imperforate doors 44 and the front, pocket defining walls 28 when the imperforate doors 44 are in the closed positions illustrated in solid lines in FIG. 1. This minimizes the draft entering the firepit P from the room.

The door frames 42 and 39 may be made from any suitable material such as copper, brass, or steel. The height of the door frames 42 and 39 is such that when the doors 44 and 40 are closed, the upper and lower frame portions 42g and 39g respectively are substantially completely visible from the outside of the fireplace. The width of the door frames 42 and 39 is such that the longitudinally innermost, vertical surfaces 42c and 40c (FIG. 2) are flush with the flanges 28b and 28c when the doors 44 and 40 are open, and when the doors 44 and 40 are closed, the laterally outer portions 42a and 40a of the door frames 42 and 39 are immediately adjacent the longitudinally outer surfaces of the flanges 28b and 28c on the pocket defining panels 28. The doors 40 and 44 can also be removed from the tracks for cleaning and the like. A latch generally designated 60, is mounted on one of the door frames for latching the doors 44 together in a conventional manner, when they are in the closed or abutting positions illustrated in FIG. 1.

ALTERNATE EMBODIMENT

Figure 6:
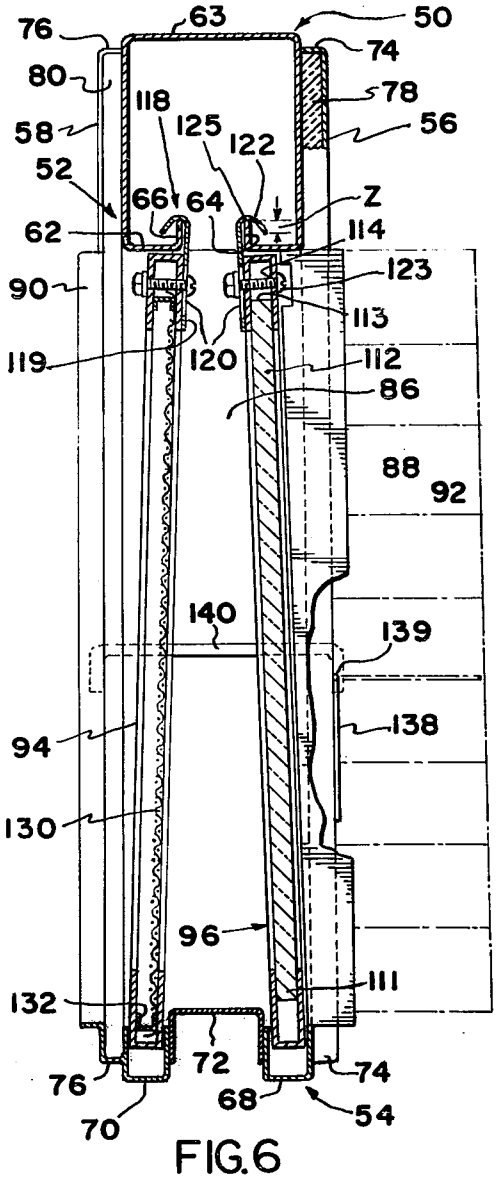
FIG. 6 is an enlarged, sectional end view, taken along the line 6—6 of FIG. 5.
Figure 5:
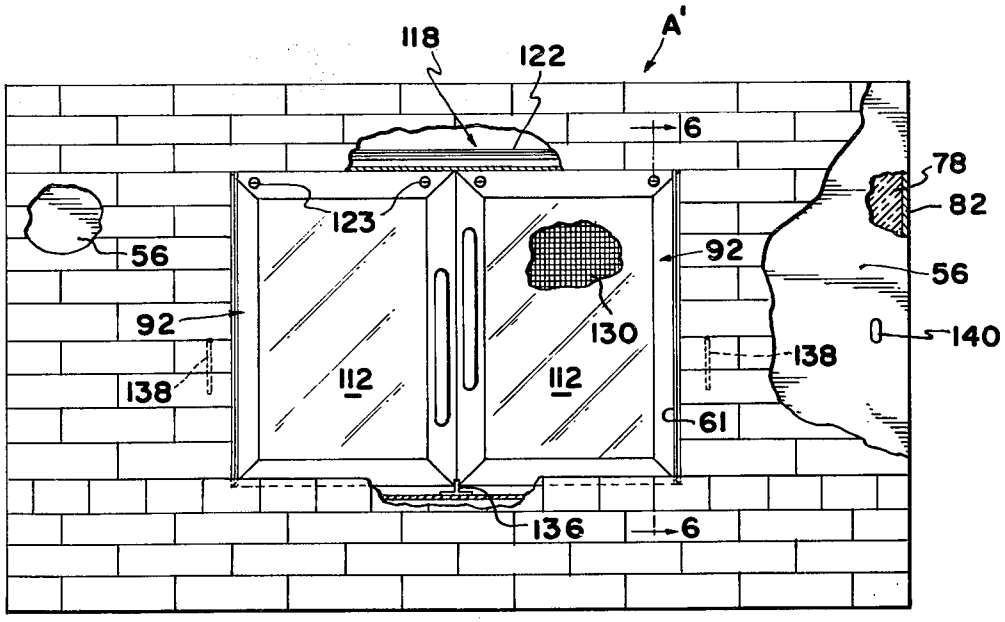
FIG. 5 is a front elevational view illustrating a slightly modified fireplace front installed on the front of a fireplace, parts of the overlying brick wall being broken away to more clearly illustrate the underlying portion of the fireplace front.
Figure 7:
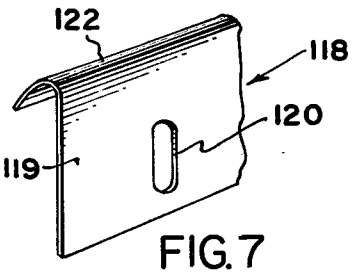
FIG. 7 is a still further enlarged fragmentary perspective view of one of the hangar brackets for hanging the doors on the tracks of the apparatus illustrated in FIGS. 5 and 6.

Referring now more particularly to the construction illustrated in FIGS. 5, 6 and 7, a fireplace front A′ is provided including a framework, generally designated 50, having an upper track, generally designated 52, and a lower track generally designated 54, spanned by front and rear walls or panels 56 and 58, respectively, on laterally opposite sides of a central frame opening 61. Parts generally similar to the parts disclosed in FIGS. 1 and 2 are identified with identical numerals.

The upper track 52 comprises an elongate, inverted, U-shaped channel member 63 having inwardly disposed flanges 62 at the lower ends thereof terminating in vertical, front and rear track rails 64 and 66 which are generally parallel and in spaced relation.

The lower track frame member 54 includes front and rear, longitudinally extending, laterally spaced, U-shaped, parallel channel track members 68 and 70 coupled together by an inverted U-shaped frame member 72. The channel tracks 66 and 68 are generally parallel to and of the same longitudinal extent as the upper track rails 64 and 66. The front and rear wall panels 56 and 58 include laterally inwardly disposed expansion flanges 74 and 76 mounted to the upper and lower track frame members 50 and 54 to define expansion cavities or pockets 78 and 80 respectively on the front and rear sides of the upper and lower tracks 52 and 54. The purposes of the expansion pockets will become apparent as the description proceeds.

The expansion flanges 74 and 76 are welded to the upper and lower track frame members 52 and 54 and are closed at their ends by end plates 82 to provide substantially air tight door receiving wells or pockets 86 on opposite sides of the central frame opening 61 which is aligned with the fire chamber opening 22. The longitudinally inner edge portions of the front and rear panels 56 and 58 terminate in laterally inwardly and laterally outwardly disposed alignment and sealing flanges 88 and 90 respectively on opposite sides of the central opening 61. The flanges 88 and 90 are identical to the vertical flanges 28a and 28b illustrated in FIG. 3.

As is illustrated in FIG. 6, the lower track channels 68 and 70 are spaced apart a greater distance than are the upper track rails 64 and 66 so that the doors mounted thereon upwardly converge as will be more particularly described hereinafter.

FIREPLACE DOORS AND METHOD OF MAKING SAME

A pair of generally rectangular, coplanar, imperforate fireplace doors, generally designated 92, are suspended for sliding movement on the upper, front, track rail 64 and are slidably received, at their lower ends, in the lower front channel track 68. A pair of screen doors, generally designated 94, are suspendably mounted for sliding movement on the upper rear track rail 66 and are slidably received in their lower ends in the lower channel track 70. Each imperforate door 92 includes a hollow, rectangular sash 96 mounted on the peripheral edge surface portions 111 of a "Pyrex" glass panel 112. Each door sash 96 includes vertically spaced end frame portions 93, having a width X, integrally joined to upper and lower side frame portions 95 having a height Y.

Referring now more particularly to FIGS. 10–15, the imperforate doors 92 are manufactured with an initially elongate, channel shaped member, generally designated 98, having a base 99 and an integral pair of upstanding, generally parallel legs 100, 101. Initially, the operator forms three 90°, V-shaped notches 102, 103 and 104 in the leg 101. The notches 102 and 103 are spaced apart such that the distance X between the roots of the V-shaped notches 102 and 103 is equal to the width X of the finished door 92. The notches 103 and 104 are spaced apart such that the distance Y between the roots of the notches 103 and 104 is equal to the height Y of the finished door 92.

One end 105 of the channel leg 101 is then removed. The leg 101 is cut at a 45° angle relative to the channel base 99 inwardly of the end thereof and then cut longitudinally adjacent the base 99 along the chain line 106′ (FIG. 10) to provide a vertically inclined terminal edge 106 defining a terminal end notch portion 107.

It is important to note that the terminal end portion 110 of base 99 remains intact and projects outwardly beyond the terminal edge 106.

The opposite end of the leg 101 is then severed along a chain line 108 inclined at an angle of 45° to the base 99 to provide a vertically inclined edge 109 defining a complementally notched portion 109′ which is complemental to the opposite notched end 107. The angle between the terminal edge 108 and a line perpendicular to the base 99 and the angle between the terminal edge 106 and a line perpendicular to the base 99 are complementary and equal 90°. Notch portions 102′, 103′ and 104′ are then cut in the other channel leg 100 identical to and immediately opposite the notches 102, 103 and 104 respectively in the leg 100. Notch portions 107 and 109′ are then cut in the ends of the leg 100 identical to and immediately opposite the notch portions 107 and 109′ respectively to provide vertically inclined terminal edges 106 and 109.

The removal of the terminal end portions 105 and 105′ define a projecting base tab portion 110 which projects outwardly beyond the terminal edge 106 of the legs 100, 101. The notches 104 and 104′ are spaced from the notch 107 such that the roots of the notches 104 and 104′ are spaced from the roots of the notch portion 107, respectively, by a distance X. Likewisely, the notches 102 and 102' are so located that the roots of the notches 102, 102' are spaced a distance Y from the roots of the notch portion 109', respectively. Aligned, mounting apertures or holes 114 are cut through the legs 100, 101 interjacent the notches 102, 102', 103 and 103'.

Figures 10, 11, 12, 13, 14, 15:
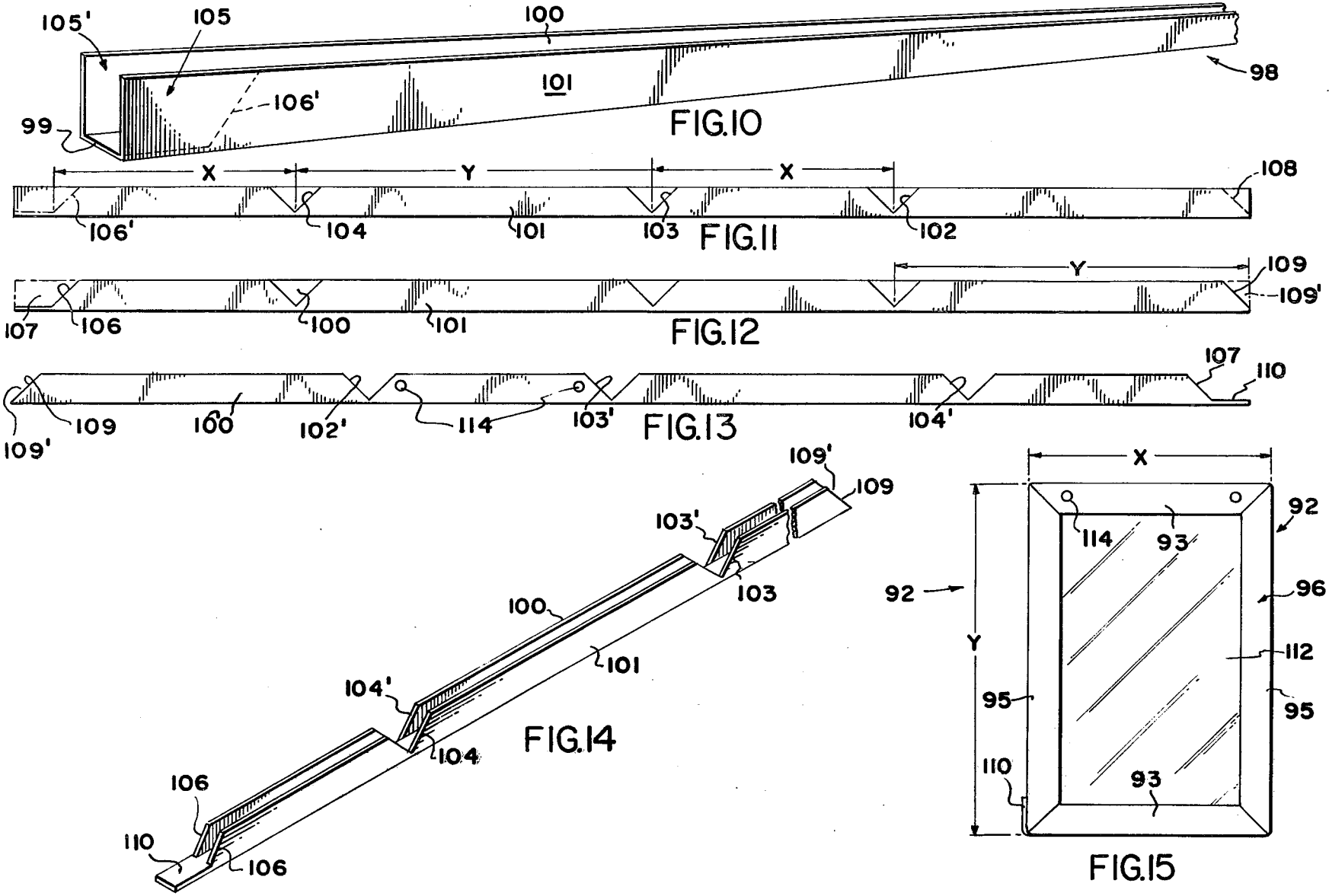
FIGS. 10–15 illustrate successive steps of a method of manufacturing a fireplace door according to the present invention.

A heat resistant, transparent, pyrex glass panel 112 is provided and the notched channel 98 is bent or folded at the roots of the notches 102, 102', 103, 103' and 104, 104' into rectangular form and concurrently mounted on the terminal edge portions thereof. The parallel legs 100, 101 are snugly received on opposite sides of the glass panel 112 and the base 99 is bent or folded such that the adjacent confronting edge portions of the respective notches 102, 103, 104, 102', 103' and 104' are disposed in abutting relation as illustrated in FIG. 15. The channel 98 is wrapped around the perimetrical edge portions 111 of the glass panel 112 to form the sash frame having vertical side frame members 95 and upper and lower frame members 93 and the terminal end base tab 110 is bent 90° into a position overlapping the distal terminal base portion 112, as illustrated in FIG. 15. The tab 110 is then welded or pop riveted to the base terminal end portion 95.

The imperforate doors 92 are suspended on the tracks 94 for sliding movement toward and away from each other between the retracted positions received in the pockets 86 and abutting positions illustrated in FIG. 5 by a pair of hanger brackets, generally designated 118. Each bracket 118 includes a generally vertical plate 119 having elongate apertures or openings 120 therein aligned with the apertures 114 in the upper portion of the frame sash. The upper end of the plate 119 terminates in a laterally outwardly flaring curvilinear flange 122 which is slidably received on the upper, front track rail, 64. The hanger brackets 118 are mounted on the inside surface of the upper sash frame portion 93 via bolts 123 passing through the aligned openings 114 and 120. As illustrated in FIG. 6, the overlying base 99 of the upper frame member 93 is spaced from the upper terminal edge portion 113 of the glass panel 112 such that mounting bolts 123 can be received in the aligned apertures 114 and 120.

The imperforate doors 92 are normally mounted in the vertical positions illustrated in FIG. 6 whereby the upper sash frame portions 93 are normally spaced from the overlying, track mounting flanges 62 a distance less than the distance Z between the terminal ends 125 of the curvilinear flanges 122 and the upper end of the upper track rail 64. This construction will prevent the doors 92 from being inadvertently removed from the track 64. When the doors 92 are so mounted, the lower ends of the doors 92 are received in the lower tracks 68 such that the lower ends of the doors 92 are suspended above the base of the track 68 a distance greater than the distance Z. When the user wants to remove the doors for cleaning or the like, he need only unturn the bolts 123 and permit the doors 92 to slide downwardly into the channel 68. The bolts 123 can then be retightened and the entire door 92 lifted upwardly to move the terminal ends 125 of the curvilinear flanges 122 upwardly to a level above the upper edge of the track rail 64 whereby the door 92 can be moved laterally inwardly to clear the track and the door can thus be removed.

The screen doors 94 are constructed identically to the doors 92 except that perforate screen panels 130 are substituted for the glass panels 112. The perforate screen panels 130 have perimetrically frame mounting members 132 which are received in the lower frame members 93.

A stop 136 is mounted in the track channels 68 and 70 at the longitudinally centers thereof. The inner vertical sash frame member 93 mounts vertically staggered handles 138.

The doors 92 and 94, when mounted on the tracks 64 and 66, diverge laterally downwardly and the curvilinear hanger flange 122 continually urges the doors 92 and 94 into the tracks, 68 and 70. This construction minimizes the drag and encourages sliding movement. It is important that the bottom of the doors do not ride on the bottom of the track channels 66 and 68 but are spaced therefrom and guided by the side portions of the channels. The curvilinear flange 122, resting on the track 64, provides a seal which inhibits the passage of air past the imperforate door 92 and thus minimizes the flow of heat up the chimney and also minimizes the passage of cool air in the summertime whereby "air conditioning" is more effective.

When the fireplace front A' is to be installed on a fireplace, the longitudinally inner, vertical sealing flange 90 will be received on the inside of the fireplace pit walls 116 as described with relation to FIGS. 1 and 2. The front cavity defining wall 56 of the unit includes a tie member 138 which is secured to the front wall via a pin 139. As the mason lays the bricks B, the member 138 is swung from an initially stowed position, parallel to the front wall 56, as illustrated in solid lines in FIG. 6, to a position normal to the wall 56 as illustrated in chain lines in FIG. 6. The ties 138 are disposed between the bricks and are embedded in the mortar between the bricks to rigidify the structure and minimize movement thereof relative to the brick wall.

Stops 140 are provided and span the front and rear wall panels 56 and 58 as illustrated in FIGS. 5 and 6 to interrupt movement of the doors 92 and 94 when they are retracted and received in the pockets 86.

ALTERNATE EMBODIMENT

Figure 8:
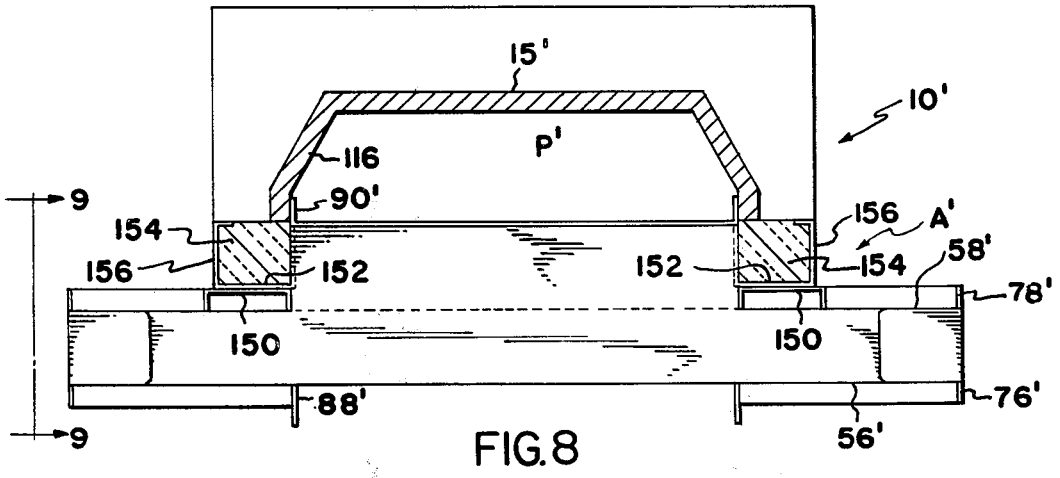
FIG. 8 is a sectional plan view of another slightly modified embodiment mounted on a "short depth" fireplace.
Figure 9:
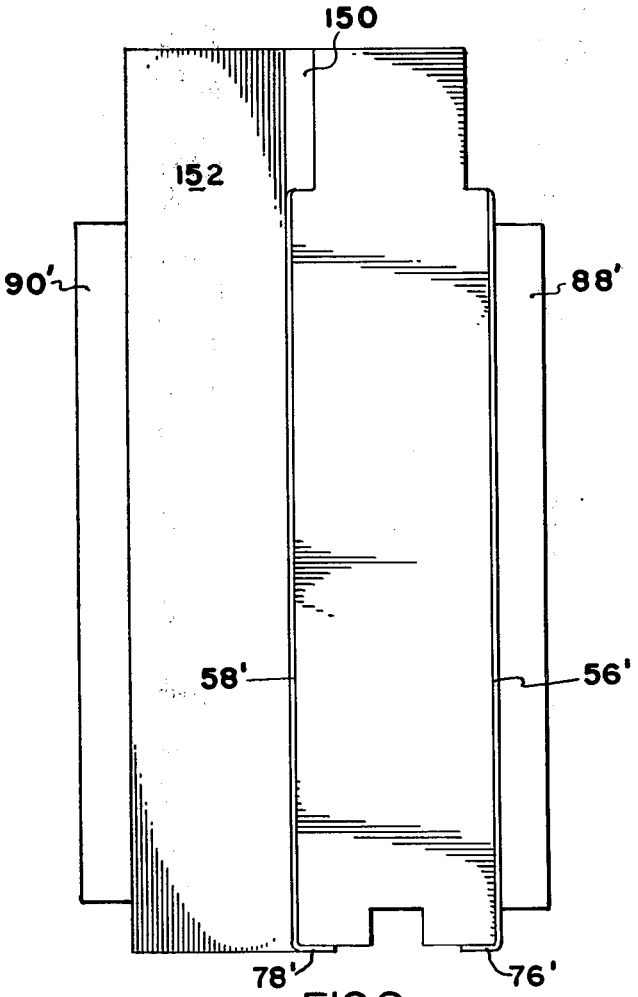
FIG. 9 is an end elevational view taken along the line 9—9 of FIG. 8.

Turning now to the embodiment illustrated in FIGS. 8 and 9, a metal fire pot or heat chamber generally designated 10' is provided and is generally identical to the fire pit or heat chamber 10 and generally similar parts are, identified by identical characters followed by a prime subscript. The heat chamber 10' differs in that the distance D between the back firepit wall 15' and the front of the firepit P' is approximately four inches less than the depth of the firepit P'.

A fireplace front, generally designated A' is provided and is constructed generally identical to the fireplace front A illustrated in FIGS. 5–7, and identical parts are identified by identical characters followed by a prime subscript. The front and rear enclosure panels 56' and 58' are inverted relative to the panels illustrated in FIGS. 5–7 such that the expansion flanges 76' and 78' are outwardly disposed as are the expansion flanges 28 in the embodiment illustrated in FIG. 2 instead of inwardly disposed as are the flanges 76 and 78 in the embodiment illustrated in FIGS. 5–7.

Mounted on the inside or rear, cavity defining wall panels 58' are a pair of reinforcing vertical channels 150 which mount a pair of generally vertical, spacer members 152 welded or otherwise suitably secured to the channels 150. The spacers 152 comprise a generally hollow, rectangular channel 150 filled with insulation 154. The depth of the sidewalls 156 of the spacer 152 is substantially equal to the difference between the depth of the firepit P and the depth of the firepit P'. In this way, the fireplace front A' can be installed on the decreased depth fireplace 10' and the imperforate doors 92' will be the same distance from the rear firepit wall 15' as the doors 92 are from the rear firepit wall 15. The remaining parts of the apparatus illustrated in FIGS. 8 and 9 are generally similar to that illustrated in FIGS. 5–7.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. Apparatus for closing the front opening of a fireplace heat chamber comprising:

a frame adapted to be mounted on the front of said heat chamber including upper and lower, generally parallel, longitudinally extending sets of front and rear tracks;

closure walls spanning said upper and lower tracks on opposite ends of a central opening adapted to be aligned with said front opening, and defining enclosed door receiving pockets on opposite ends of said central opening, said closure walls including front and rear walls spanning the upper ends of the front and rear sides of said tracks, at least said front wall being expansible when heated;

a pair of generally co-planar, perforate doors mounted on one of said front and rear sets of tracks for sliding movement between abutting positions closing said central opening and spread positions received in said pockets at opposite ends of said central opening;

a pair of generally co-planar, generally imperforate doors mounted on the other of said front and rear sets of tracks for sliding movement between abutting positions covering said central opening and spread positions received in said pockets at opposite ends of said central opening; and expansion wall spacer means on at least said front wall defining expansion cavities alongside said front wall for receiving a portion of said front wall when said front wall is heated and expands.

2. The apparatus set forth in claim 1 wherein said rear wall is expansible, said expansion wall spacer means includes upper and lower expansion wall spacer means mounting said front and rear walls on said upper and lower tracks forwardly and rearwardly, respectively, in spaced relation with the planes of said doors to define expansion cavities between said front and rear walls and said doors so that said front and rear walls and said doors can expand and said front and rear walls will not interfere with movement of said doors, when said walls and doors are heated.

3. The apparatus as set forth in claim 1 wherein said expansion wall spacer means comprises longitudinally spaced apart generally vertical forwardly extending flange means on said front wall.

4. The apparatus as set forth in claim 1 including tie bar means, mounted on said front wall for being received between the bricks of a brick formed wall.

5. The apparatus as set forth in claim 4 wherein said tie bar means is mounted on said front wall for movement between a stowed position alongside said wall and an operative position generally perpendicular to said front wall.

6. The apparatus as set forth in claim 1 including hangar brackets for vertically supporting said doors for sliding movement on said upper tracks, said lower tracks guiding movement of the lower ends of said doors, said upper tracks comprising longitudinally extending guide rails, said brackets comprising longitudinally extending inverted, curvilinear channels slidably received on said rails.

7. The apparatus as set forth in claim 6 wherein said lower tracks comprise longitudinal slots receiving said doors, said apparatus further including means adjustably mounting said doors on said brackets for vertical movement between a lowered position in which said bracket and said door can be concurrently moved upwardly and said channel can be moved laterally above said rail and a raised position in which the lower edges of said doors are suspended above the bottom of said track.

8. The apparatus as set forth in claim 1 including sealing means for inhibiting the passage of air between one of said front and rear wall means and said imperforate doors when said imperforate doors are in said abutting positions to control burning in said fireplace heat chamber.

9. The apparatus as set forth in claim 1 wherein said imperforate doors each comprise a sash and a transparent panel mounted by said sash, said sash comprising a unitary one-piece, perimetrically extending channel having a U-shaped cross section.

10. The apparatus as set forth in claim 1 including spacer means, substantially equal to the width of said track mounted on said rear wall for spacing said imperforate door from said chamber a predetermined distance.

11. The apparatus as set forth in claim 1 including spacer means mounted on said rear wall on opposite sides of said central opening for spacing said perforate doors a predetermined distance from said fire chamber; and top wall means spanning said spacer means and extending rearwardly from said rear wall and adapted to bear against said fireplace chamber.

12. Apparatus for closing the front opening of a fireplace chamber comprising:

frame means adapted to be mounted on the front of said heat chamber including upper and lower, generally parallel, longitudinally extending sets of front and rear tracks;

door receiving pockets spanning said tracks on opposite ends of a central opening adapted to be aligned with said fireplace opening; and a pair of generally co-planar imperforate doors;

bracket means suspendably mounting said perforate doors on said upper tracks for sliding movement between abutting positions closing said central opening and spread positions received in said pockets at opposite ends of said central opening;

said lower tracks comprising guide slots receiving the lower edge portions of said doors;

said bracket means comprising inverted channels normally mounting said doors at such a level that the lower edges of said doors are spaced above the bottom of said slots; and means releasably coupling said bracket means to said doors such that said bracket means can be moved relative to said doors to a level above the level of said upper tracks.

13. Apparatus for closing the front opening in a fireplace heat chamber comprising:

frame means adapted to be mounted on the front of said heat chamber including upper and lower, generally parallel, sets of front and rear tracks;

a pair of screen doors received in one of said front and rear sets of tracks for sliding movement between adjacent positions covering said opening and spread positions at opposite sides of said opening;

a pair of heat resistant, imperforate doors received in the other of said front and rear sets of tracks for sliding movement between abutting positions covering said opening and spread positions at opposite sides of said opening;

said frame means including enclosed door-receiving pockets, having front and rear wall means, at laterally opposite sides of said opening for receiving said doors in said spread positions; and means for sealing said frame means to said imperforate doors to inhibit the passage of air between one of said front and rear wall means and said imperforate doors when said imperforate doors are in said abutting positions to control burning in the fireplace heat chamber;

said sealing means including horizontally spaced, generally vertical, stop means on said pockets at horizontally opposite sides of said opening; and generally vertical flange means on said imperforate doors for engaging said flange means when said imperforate doors are in said abutting positions.

14. The apparatus as set forth in claim 13 wherein said latter mentioned inhibiting means comprises horizontally spaced, generally vertical, rearwardly converging flange means, extending rearwardly of said rear wall means, adapted to mate with the portions of said heat chamber.

15. Apparatus for closing the front opening in a fireplace heat chamber comprising:

frame means adapted to be mounted on the front of said heat chamber including upper and lower, generally parallel, sets of front and rear tracks;

a pair of screen doors received in one of said front and rear sets of tracks for sliding movement between adjacent positions covering said opening and spread positions at opposite sides of said opening;

a pair of heat resistant, imperforate doors received in the other of said front and rear sets of tracks for sliding movement between abutting positions covering said opening and spread positions at opposite sides of said opening;

said frame means including enclosed door-receiving pockets, having front and rear wall means, at laterally opposite sides of said opening for receiving said doors in said spread positions;

means for sealing said frame means to said imperforate doors to inhibit the passage of air between one of said front and rear wall means and said imperforate doors when said imperforate doors are in said abutting positions to control burning in the fireplace heat chamber; and means for inhibiting the passage of air between said rear wall means of said pockets and said heat chamber.

16. Apparatus for closing the front opening in a fireplace heat chamber comprising:

frame means adapted to be mounted on the front of said heat chamber including upper and lower, generally parallel, sets of front and rear tracks;

a pair of screen doors received in one of said front and rear sets of tracks for sliding movement between adjacent positions covering said opening and spread positions at opposite sides of said opening;

a pair of heat resistant, imperforate doors received in the other of said front and rear sets of tracks for sliding movement between abutting positions covering said opening and spread positions at opposite sides of said opening;

said frame means including enclosed door-receiving pockets, having front and rear wall means, at laterally opposite sides of said opening for receiving said doors in said spread positions;

means for sealing said frame means to said imperforate doors to inhibit the passage of air between one of said front and rear wall means and said imperforate doors when said imperforate doors are in said abutting positions to control burning in the fireplace heat chamber; and forwardly extending, generally vertical flange means on said front wall means at opposite sides of said opening, adapted to be engaged by fireplace brick to inhibit the flow of air therebetween; said sealing means including rearwardly extending, generally vertical, flange means on said rear wall means at opposite sides of said opening for mating with the side walls of said heat chamber to inhibit the flow of air therebetween.

17. The apparatus as set forth in claim 16 wherein the planes of said forwardly extending flange means are generally perpendicular to the plane of said front wall means, and said rearwardly extending flange means are generally rearwardly converging.

18. The apparatus as set forth in claim 17 wherein the upper end of said rearwardly extending flange means is substantially flush with the lower edge of said upper set of tracks; and the lower end of said rearwardly extending flange means is substantially flush with the upper edge of the lower set of tracks.

* * * * *